US006459866B1

(12) United States Patent
Meguro

(10) Patent No.: US 6,459,866 B1
(45) Date of Patent: Oct. 1, 2002

(54) CLEANING DEVICE AND IMAGE FORMING APPARATUS HAVING THE CLEANING DEVICE

(75) Inventor: Takehiro Meguro, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/934,295

(22) Filed: Aug. 21, 2001

(30) Foreign Application Priority Data

Aug. 23, 2000 (JP) ..... 2000-252665

(51) Int. Cl.[7] ..... G03G 15/08; G03G 21/00; G03G 21/12

(52) U.S. Cl. ..... 399/102; 399/350; 399/351; 399/360

(58) Field of Search ..... 399/343, 349, 399/350, 351, 360, 358, 102

(56) References Cited

U.S. PATENT DOCUMENTS 4,323,306 A * 4/1982 Ito et al. ..... 399/358
4,501,620 A * 2/1985 Oda ..... 399/350
4,982,240 A * 1/1991 Nakano ..... 399/350
5,175,591 A * 12/1992 Dunn et al. ..... 399/349
5,543,906 A * 8/1996 Kanda ..... 399/350
6,055,404 A * 4/2000 Yamazaki et al. ..... 399/350
6,128,461 A * 10/2000 Yoshikawa ..... 399/351
6,137,973 A * 10/2000 Nishiuwatoko et al. ..... 399/350

* cited by examiner

*Primary Examiner*—Susan S. Y. Lee
(74) *Attorney, Agent, or Firm*—Frishauf, Holtz, Goodman & Chick, P.C.

(57) ABSTRACT

A cleaning device comprises a device case having a toner collecting space, a blade holder swingably supported in directions in which the blade holder approaches and leaves from the photosensitive drum, an elastic seal member attached to one of a wall of the toner collecting space and the blade holder, between an outer face of the wall forming the toner collecting space and the blade holder, in order to be forcibly brought into contact with one of the wall forming the toner collecting space and the blade holder, wherein the blade holder or the wall forming the toner collecting space has a protrusion that is at least partly welded into the elastic seal member, and is forcibly brought into contact with the elastic seal member.

37 Claims, 5 Drawing Sheets

CLEANING DEVICE AND IMAGE FORMING APPARATUS HAVING THE CLEANING DEVICE

CROSS-REFERENCE TO RELATED APPLICATIONS

This application is based upon and claims the benefit of priority from the prior Japanese Patent Application No. 2000-252665, filed Aug. 23, 2000, the entire contents of which are incorporated herein by reference.

BACKGROUND OF THE INVENTION

1. Field of the Invention

The present invention relates to a cleaning device and an image forming apparatus having the cleaning device.

2. Description of the Related Art

In the image forming with use of the image forming apparatus such as a facsimile, a printer, or a copying machine, which employs electrophotography, steps of charging and exposing are performed by the rotation of a photosensitive drum, a developing step is then performed to form a toner image on a circumference of the photosensitive drum, subsequently, a transfer step follows thereto to transfer the toner image onto a record paper, and a discharging step is performed thereafter to discharge the circumference of the photosensitive drum.

In the image forming cycle, the residual toner left on the circumference of the photosensitive drum after the transfer step is performed is unnecessary for the discharging step and the charging step performed after the transfer step, and thus the image forming apparatus is provided with a cleaning device for performing a cleaning step between the transfer step and the discharging step, during which the residual toner on the circumference of the photosensitive drum is removed and collected.

As shown in FIG. 11, the cleaning device 7 comprises a device case 21 having a toner collecting space 22 opened to the circumference of the photosensitive drum 2; a blade holder 23 swingably supported by the device case 21 in the directions in which the blade holder approaches and leaves from the photosensitive drum 2 and extending to the opening of the toner collecting space 22; a blade 25 attached to the blade holder to cover together with the blade holder the opening of the toner collecting space 22 and to contact with the circumference of the photosensitive drum 2 when the blade holder swings in the direction approaching the photosensitive drum 2, so that the blade rakes up the toner left on the circumference of the photosensitive drum 2 toward the inside of the toner collecting space 22; and an elastic member 26 for applying a force to the blade holder in the direction in which the blade holder approaches the photosensitive drum so that the blade urgingly contacts onto the circumference of the photosensitive drum 2.

In order to prevent the leak of the toner collected in the toner collecting space 22 formed in the device case 21, the cleaning device is formed such that the opening of the toner collecting space 22 facing the circumference of the photosensitive drum 2 is covered with the blade holder 23, the blade 25, and the photosensitive drum 2, and the space between the outer face of the wall forming the toner collecting space 22 and the blade holder 23 is closed by an elastic seal member 28 attached to the wall of the toner collecting space 22 or the blade holder 23 to urgingly contact with the blade holder 23 or the wall of the toner collecting space 22.

The conventional elastic seal member 28 is formed such that contact faces 28*m* and 28*n* urgingly contacting with the blade holder 23 or the wall of the toner collecting space 22 are formed in planes, and contact faces 23*m* and 23*n* of the blade holder 23 and the wall of the toner collecting space 22 with which the contact faces of the elastic seal member 28 urgingly contact are also formed in planes so that the elastic seal member 28 can contact with the blade holder 23 or the wall of the toner collecting space 22 on a plane. In order to prevent the leak of the toner from the contacting face of the elastic seal member 28 and the blade holder 23 or the wall of the toner collecting space 22, the cleaning device 7 is installed in the body of the image forming apparatus 1 so that the blade holder 23 and the wall of the toner collecting space 22 urgingly contact with the elastic seal member 28 with a necessary pressure.

However, according to the above-mentioned structure of the conventional cleaning device, the entire plane contact faces 28*m* and 28*n* of the elastic seal member 28 urgingly contact with the plane contact face 23*m* or 23*n* of the blade holder 23 or the wall of the toner collecting space 22 in order to prevent the leak of the toner. With such a structure, when the cleaning device 7 is installed in the body of the image forming apparatus 1, the blade holder 23 and the blade 25 will shift from the predetermined position toward the photosensitive drum 2 (in the direction leaving from the elastic seal member). In addition, the elasticity of the elastic seal member 28 will decrease due to the yearly deterioration to shrink the elastic seal member. In accordance with the shrink of the elastic seal member, the contact face shifts backward from the desired contact position, which makes difficult to surely make contact the contact faces of the elastic seal member 28 and the blade holder 23 or the wall of the toner collecting space 22, with the result that the sealing performance of the contact faces will be deteriorated to leak the toner from the contacting section.

In order to solve the uncertainness of the contact, the contact pressure applied by the blade holder 23 or the wall of the toner collecting space 22 to the elastic seal member 28 is proposed to be increased. In this case, however, the elastic seal member 28 is strongly urged and compressed to generate a strong reaction force against the compression. The reaction force acts on the blade holder 23 to increase the pressure with which the blade 25 contacts with the circumference of the photosensitive drum 2. If the blade 25 contacts the circumference of the photosensitive drum 2 with more pressure than the necessary one, some problems such as the damage of the circumference of the photosensitive drum 2 may occur.

BRIEF SUMMARY OF THE INVENTION

The object of the present invention is to provide a cleaning device having improved sealing performance on contact faces of the elastic seal member and the blade holder or the wall of the toner collecting space.

The other object of the present invention is to provide an image forming apparatus having the cleaning device mentioned above.

According to the first embodiment of the present invention, a cleaning device can be provided, which comprises a device case having a toner collecting space opened to a surface of a photosensitive drum; a blade holder swingably supported by the device case in directions in which the blade holder approaches and leaves from the photosensitive drum and extending to the opening of the toner collecting space; a blade attached to the blade holder in order to rake up toner left on the surface of the photosensitive drum toward inside of the toner collecting space; an urging member for applying a force to the blade holder in a direction in which the blade holder approaches the photosensitive drum so that the blade urgingly contacts onto the surface of the photosensitive drum; an elastic seal member attached to one of a wall forming the toner collecting space and the blade holder, between an outer face of the wall forming the toner collecting space and the blade holder facing the wall; and a protrusion attached to one of the blade holder and the wall forming the toner collecting space in order to prevent toner raked by the blade from leaking through a space between the blade holder and the wall of the toner collecting space.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiment of the invention, and together with the general description given above and the detailed description of the embodiment given below, serve to explain the principles of the invention.

DETAILED DESCRIPTION OF THE INVENTION

Figure 1:
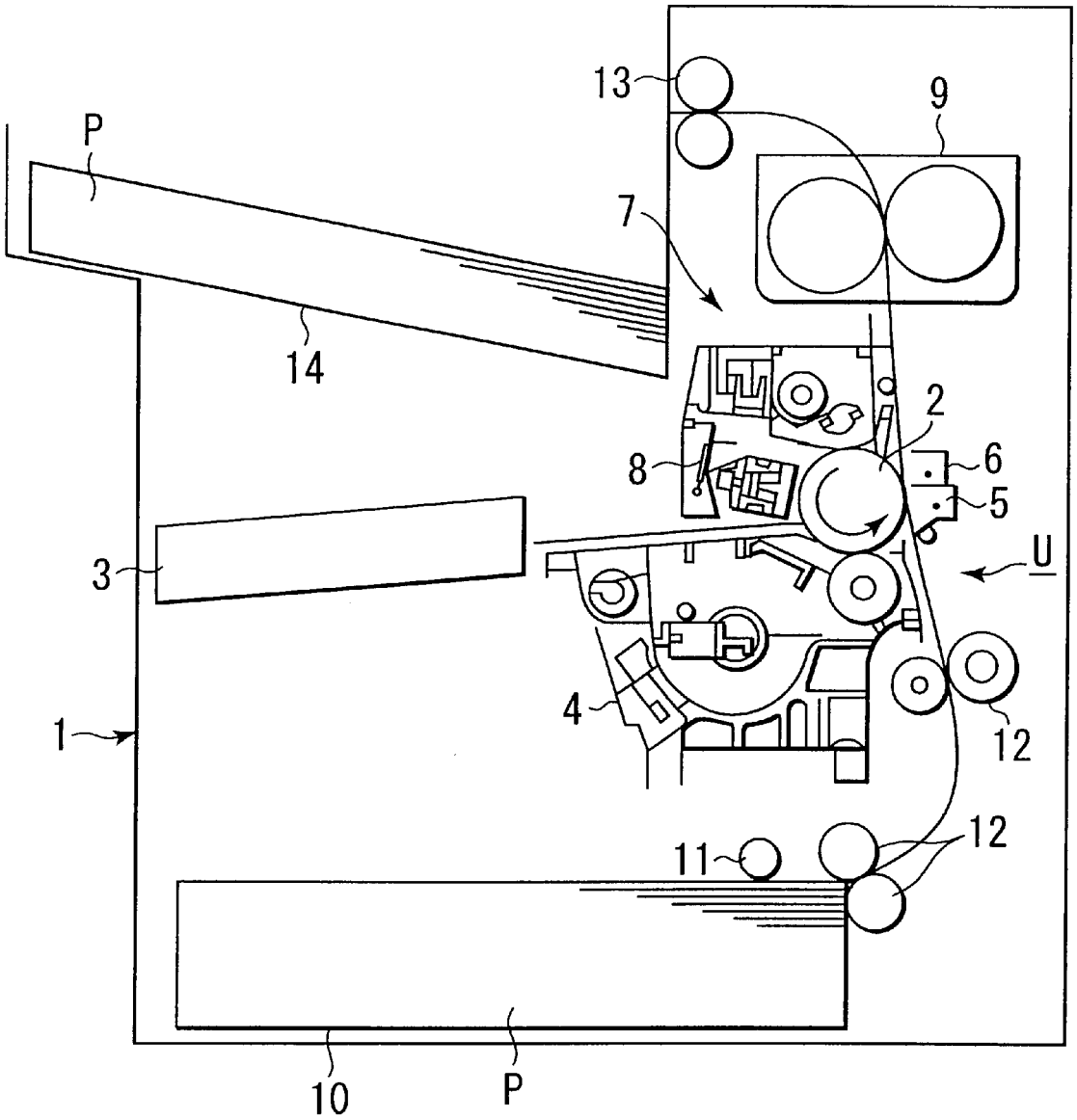
FIG. 1 is a sectional view schematically showing the image forming apparatus having the cleaning device according to each of the embodiments of the present invention.

The first embodiment of the present invention will be described below in. conjunction with FIGS. 1 and 2. FIG. 1 is a sectional view schematically showing the image forming apparatus having the cleaning device. The apparatus employs the image forming method in which the image forming is performed by vertically conveying the recording paper from the lower section to the upper section.

In FIG. 1, 1 denotes an image forming apparatus body, 2 denotes a photosensitive drum rotated in the direction shown by an arrow, 3 denotes an exposing device for exposing the circumference as the surface of the photosensitive drum to form an electrostatic latent image, 4 denotes a developing device for developing the electrostatic latent image by supplying toner to the circumference of the photosensitive drum to form a toner image, 5 denotes a transfer device for transferring the toner image formed on the circumference of the photosensitive drum to a recording paper P by making the recording paper P contact with the circumference of the photosensitive drum, 6 denotes a peeling device for peeling the recording paper P from the circumference of the photosensitive drum, 7 denotes a cleaning device for removing residual toner left on the circumference of the photosensitive drum to collect them, 8 denotes a charging device for uniformly charging the circumference of the photosensitive drum, and 9 denotes a fixing device for fixing the toner image on the recording paper P to which the toner image is transferred. The photosensitive drum 2, the developing device 4, the cleaning device 7 and the charging device 8 are collected as a unit to constitute a process unit U.

10 denotes a feeding cassette containing the stacked recording papers P, 11 denotes a picking roller for picking the recording papers P out of the feeding cassette one by one, 12 denotes a conveying roller for conveying the picked recording paper P to the process unit U, and 13 denotes an ejecting roller for ejecting the recording paper P on which the image is formed to an eject tray 14 placed out of the image forming apparatus body 1.

The cleaning device 7 will be described next with reference to FIG. 2.

Figure 2:
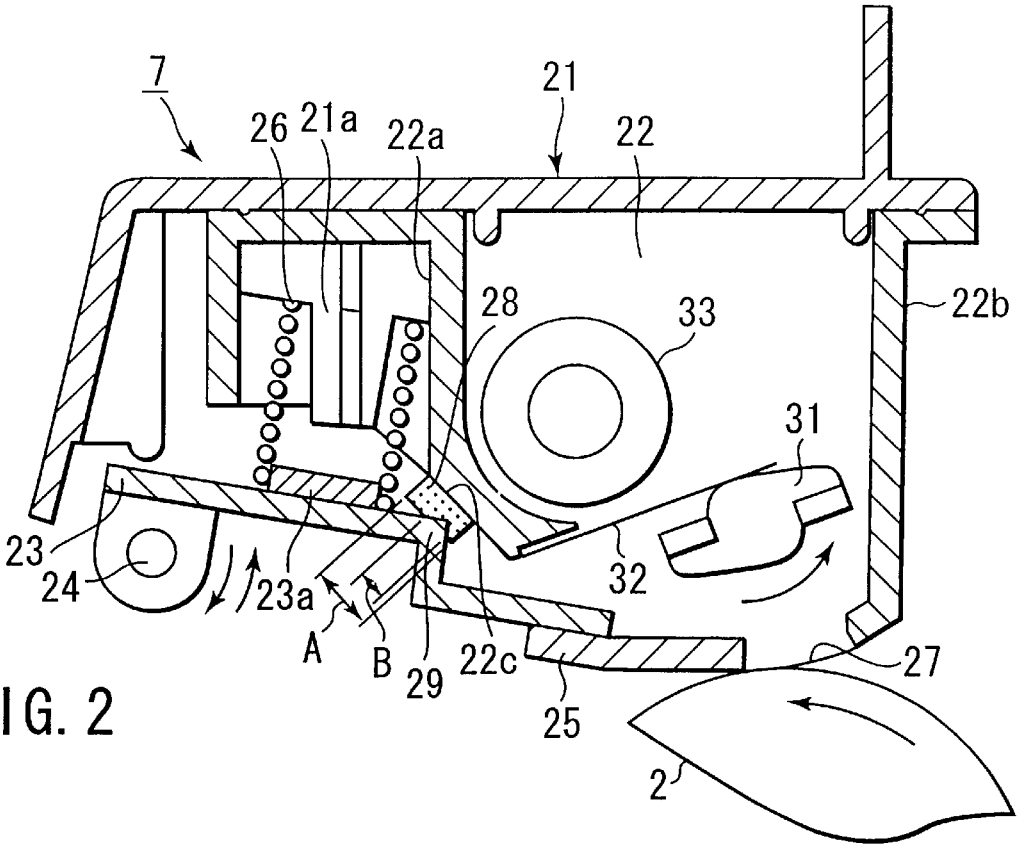
FIG. 2 is a sectional view showing the cleaning device according to the first embodiment.

FIG. 2 is a sectional view showing the cleaning device 7 according to this embodiment. In the cleaning device 7 according to this embodiment, an elastic seal member is provided on the wall of a toner collecting space of the cleaning device body, and a blade holder is provided with a protrusion. The cleaning device 7 is placed in an upper left portion with respect to the photosensitive drum 2 in FIG. 7.

In FIG. 2, 21 denotes a device case arranged in parallel to the photosensitive drum 2. The device case is provided with a toner collecting space 22 having in the bottom face an opening facing the circumference of the photosensitive drum 2. The toner collecting space 22 is formed by a pair of side walls 22*a* and 22*b* arranged at a space in the direction in which the drum is rotated, so as to be put between the side walls.

23 denotes a blade holder arranged in parallel to the photosensitive drum 2, and extending from a position spaced from the toner collecting space 22 to the position below the opening of the toner collecting space 22. The front end portion of the blade holder is positioned to cover the opening of the toner collecting space 22. The proximal end portion of the blade holder 23 is supported on the device case 21 by a axis 24 arranged in parallel to the photosensitive drum 2 such that the front end portion positioned to cover the opening of the toner collecting space 22 swings in the directions approaching and leaving from the photosensitive drum 2.

25 denotes a blade attached to the front end portion of the blade holder 23 to cover together with the blade holder 23 the opening of the toner collecting space 22. The blade 25 is swung together with the blade holder 23 in accordance with the swing of the blade holder in the directions approaching and leaving from the photosensitive drum 2, and when the blade holder swings in the direction approaching the photosensitive drum 2, contacts with the circumference of the photosensitive drum 2. The blade 25 contacting the circumference of the photosensitive drum 2 rakes up the toner left on the circumference of the photosensitive drum 2 toward the inside of the toner collecting space 22.

26 denotes a compressed coil spring as an example of an elastic member. The compressed coil spring 26 is arranged between a spring receiver 21*a* formed in the device case 21 to be positioned outside the toner collecting space 22 and a spring receiver 23*a* formed on the proximal end portion of the blade holder 23, and applies a force to the blade holder 23 in the direction in which the blade holder 23 approaches the photosensitive drum 2 so that the blade 25 urgingly contacts onto the circumference of the photosensitive drum 2.

The opening of the toner collecting space 22 in the device case 21 is covered with the blade holder 23, the blade 25, and the circumference of the photosensitive drum 2. A recovery sheet 27 attached to the lower side of the side wall 22*b* also functions as a cover to close the opening.

The space between the outer face of the side wall 22*a* forming the toner collecting space 22 and the blade holder 23 positioned outside the side wall 22*a* is provided with the following constitution. In FIG. 2, 28 denotes the elastic seal member made of a material having elasticity, such as sponge, and formed in a stick having a length corresponding to the length of the photosensitive drum 2 and a quadrangle section. Furthermore, the elastic seal member 28 has a first face and a second face. The first face of the elastic seal member 28 is fixed to either the wall section 22a of the toner collecting space 22 or the blade holder 23. The second face of elastic seal member 28 is only brought in contact with either the wall section 22*a* of the toner collecting space 22 or the blade holder 23. An attaching face 22*c* inclined to the blade holder 23 is formed on the outer face of the lower portion of the side wall 22*a* forming the toner collecting space 22 so as to be parallel to the photosensitive drum 2. The first face of the elastic seal member 28 is arranged to be parallel to the photosensitive drum 2 and attached to the attaching face 22*c* with use of means such as adhesive. The elastic seal member 28 is arranged between the outer face of the side wall 22*a* forming the toner collecting space 22 and the blade holder 23 facing the side wall 22*a*, is fixedly attached to the wall section 22*a*, and is forcibly brought into contact with the blade holder 23 on the opposite side (the second face) of the attached side. It should be noted that, in this case, the second face of the elastic member 28 is not fastened to the blade holder 23. The blade holder 23 is provided with a protrusion 29 wedging into a region of the surface of the elastic seal member 28 facing the blade holder 23, at the portion facing the elastic seal member 28 attached to the attaching face 22*c* on the lower portion of the side wall 22*a* forming the toner collecting space 22. The protrusion 29 is wedged into the second face of the elastic member 28. The protrusion 29 is formed by bending the middle portion of the blade holder 23 at right angles, for example, toward the elastic seal member 28 such that the corner of the bending portion protrudes to the elastic seal member 28. The width B of the protrusion (the corner of the bending portion) 29 at which the protrusion is wedged into the elastic seal member 28 is less than the width A of the entire surface of the elastic seal member 28 facing the blade holder 23.

When the cleaning device 7 is installed in the process unit U such that the blade 25 urgingly contacts with the photosensitive drum 2, a reaction force is applied to the blade holder 23 due to the resistance of the photosensitive drum 2 in the direction in which the blade holder 23 leaves from the photosensitive drum 2. By this reaction force, the protrusion 29 as the corner of the bending portion of the blade holder 23 encroaches to the facing region (the second face) of the surface of the elastic seal member 28 attached to the side wall 22*a* forming the toner collecting space 22 and is forcibly brought into contact with the elastic seal member 28. The elastic seal member 28 is urged by the protrusion 29 of the blade holder 23 and compressed due to its own elasticity. In this time, the (sectional) width B of the protrusion 29 as the corner of the bending portion of the blade holder 23, at which the protrusion is wedged into the elastic seal member 28 is less than the width A of the entire surface of the elastic seal member 28 facing the blade holder 23.

The corner of the bending portion of the blade holder 23 is formed in a mountain shape since it is a corner. Therefore, when the protrusion 29 as the corner of the bending portion of the blade holder 23 encroaches to the surface (the second face) of the elastic seal member 28, the elastic seal member 28 is compressed in a shape corresponding to the outer shape of the protrusion 29, and a contact face extending and bending in the direction of the thickness of the elastic seal member 28 is formed between the outer face of the protrusion 29 and the surface of the elastic seal member 28. The contact face extending in the direction of the thickness of the elastic seal member 28 and bending in a V-shape is bent, and thus has high sealing performance since the toner cannot easily passes through it. In addition, even if the protrusion 29 and the elastic seal member 28 shift in the direction leaving from each other, the protrusion 29 extending in the direction of the thickness of the elastic seal member 28 merely shifts in the direction leaving from the elastic seal member 28 within the scope of the thickness of the elastic seal member 28 and will not fall out from the elastic seal member 28 since the path is bent and extends in the direction of the thickness of the elastic seal member 28. With such a structure, the contact between the outer face of the protrusion 29 and the surface of the elastic seal member 28 can be surely maintained.

In this manner, the space between the outer face of the side wall 22*a* forming the toner collecting space 22 and the blade holder 23 positioned out of the side wall 22*a* is sealed by the elastic seal member 28.

The toner collecting space 22 in the device case 21 is provided inside with a rotation paddle 31 for collecting toner raked from the photosensitive drum 2 by the blade 25, a scraper 32 for scraping the toner sticking to the rotation paddle 31, and an auger conveyer 33 for conveying the collected toner to the outside of the device.

According to the structure of the cleaning device 7, the protrusion 29 provided to the blade holder 23 is wedged into a facing region of the surface of the elastic seal member 28, by which a path extending and bending in a V-shape is formed on the contact face of the outer face of the protrusion 29 and the surface of the elastic seal member 28. By virtue of this path, the toner collected into the toner collecting space 22 can be prevented from leaking from the contact face to the outside. Particularly, even if the blade holder 23 and the blade 25 will shift from the predetermined position toward the photosensitive drum 2 (in the direction leaving from the elastic seal member) when the cleaning device 7 is installed in the body of the image forming apparatus 1, or even if the elasticity of the elastic seal member 28 will decrease due to the yearly deterioration to shrink the elastic seal member and the contact face shifts backward from the desired contact position in accordance with the shrink of the elastic seal member, the bending path will compensate the shift to maintain the sure contact between the blade holder 23 and the elastic seal member 28. Accordingly, the sealing performance of the contact face of the elastic seal member 28 and the blade holder 23 or the wall of the toner collecting space 22, in other words, the sealing performance between the blade holder 23 and the wall of the toner collecting space 22 can be improved.

With this structure, the contact pressure applied by the blade holder 23 to the elastic seal member 28 does not need to be increased, and thus the problems such as the damage of the circumference of the photosensitive drum 2, which may be caused by the pressure with which the blade 25 contacts with the circumference of the photosensitive drum 2, which is increased by the strong reaction force of the elastic seal member 28 generated against the increased contact pressure.

Further, the protrusion 29 provided to the wall of the blade holder 23 contacts a region of the surface of the elastic seal member 28, and thus the contact area decreases in comparing with the case where the entire surface of the elastic seal member 28. With the result, the reaction force generated in the elastic seal member 28 can be also decreased, thereby the problems which may by caused by the blade 25 on the photosensitive drum 2 can be prevented further certainly.

According to the present embodiment, the protrusion 29 of the blade holder 23 can be formed in a suitable structure to form a bending path on the surface of elastic seal member 28 at which the blade holder 23 and the elastic seal member 28 contact each other.

The image forming apparatus according to the present embodiment has the cleaning device 7 having the improved sealing performance of the contact faces between the elastic seal member 28 and the blade holder 23, in other words, the contact faces between the blade holder 23 and the wall of the toner collecting space 22, without increasing the contact force of the blade 25 on the circumference of the photosensitive drum 2 more than the necessary one.

Figure 3:
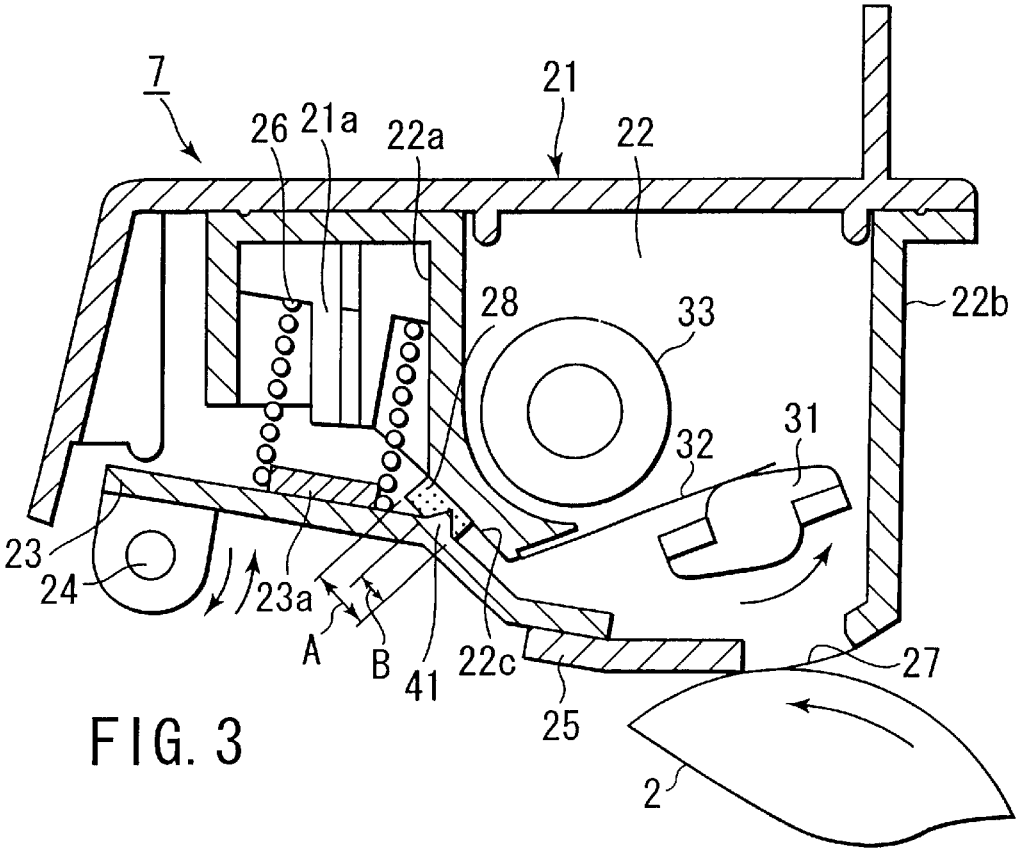
FIG. 3 is a sectional view showing the cleaning device according to the second embodiment.

FIG. 3 is a sectional view showing the cleaning device according to the second embodiment. In this embodiment, the blade holder 23 opposite to the second face of the elastic seal member 28 is provided with a protrusion 41 having a pointed section.

Figure 4:
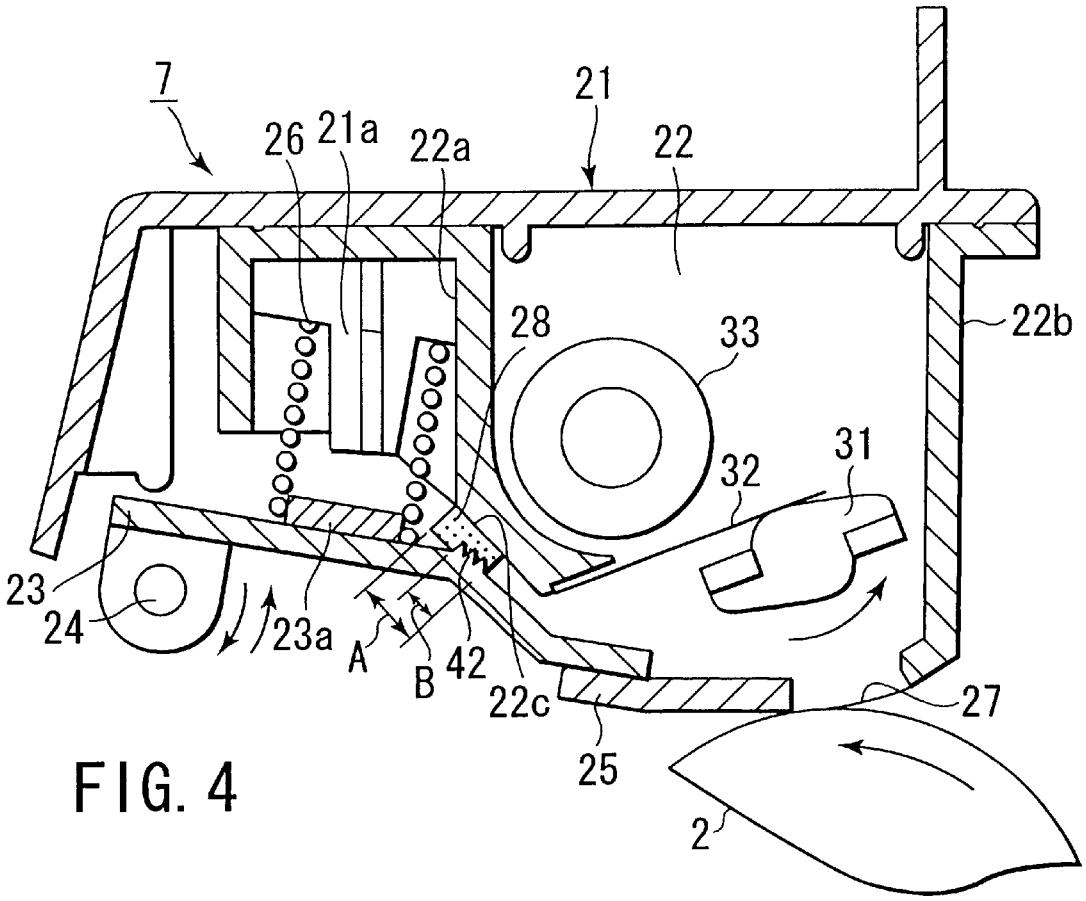
FIG. 4 is a sectional view showing the cleaning device according to the third embodiment.

FIG. 4 is a sectional view showing the cleaning device according to the third embodiment. In this embodiment, the blade holder 23 opposite to the second face of the elastic seal member 28 is provided with a protrusion 42 having a waved section.

In FIGS. 3 and 4, the same portions are denoted as the same symbols. The protrusions 41 and 42 in these embodiments shown in FIGS. 3 and 4 can attain the same effect as that described in the aforementioned embodiment. According to the second and third embodiments, the protrusion provided to the blade holder 23 can be formed in a suitable structure to form a bending path on the surface of elastic seal member 28 at which the blade holder 23 or the wall of the toner collecting space 22 and the elastic seal member 28 contact each other.

Figure 5:
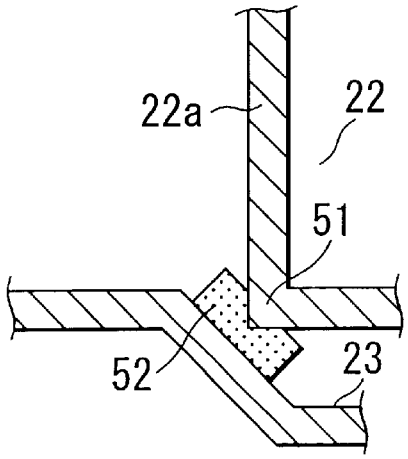
FIG. 5 is an enlarged sectional view showing the closing section between the blade holder and the wall of the toner collecting space in the cleaning apparatus according to the fourth embodiment.
Figure 6:
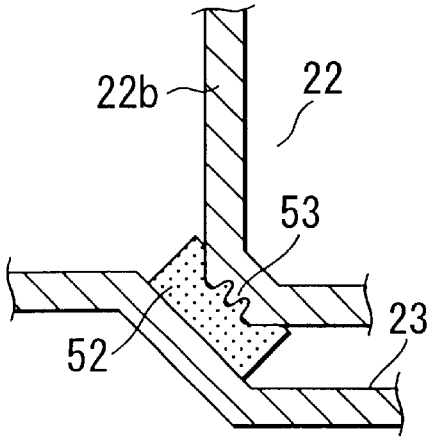
FIG. 6 is an enlarged sectional view showing the closing section between the blade holder and the wall of the toner collecting space in the cleaning apparatus according to the fifth embodiment.

FIGS. 5 and 6 are enlarged sectional views respectively showing the closing section between the blade holder and the wall of the toner collecting space in the cleaning apparatus according to the fourth and fifth embodiments in which the toner collecting space is provided at the wall with a protrusion.

FIG. 5 shows an embodiment in which the blade holder 23 is attached with the first face of an elastic seal member 52, and a protrusion 51 as a corner of a bending portion is formed on an outer face of the side wall 22*a* of the toner collecting space 22 so as to forcibly brought into contact with the elastic seal member 52 attached to the blade holder 23.

FIG. 6 shows an embodiment in which the blade holder 23 is attached with the first face of an elastic seal member 52, and a waved protrusion 53 is formed on an outer face of the side wall 22*a* of the toner collecting space 22 so as to be forcibly brought into contact with the second face of the elastic seal member 52 attached to the blade holder 23.

According to these embodiments, the protrusion provided to the side wall 22*a* of the toner collecting space 22 can be formed in a suitable structure to form a bending path on the surface of elastic seal member 52 at which the blade holder 23 or the wall of the toner collecting space 22 and the elastic seal member 52 contact each other.

Figure 7:
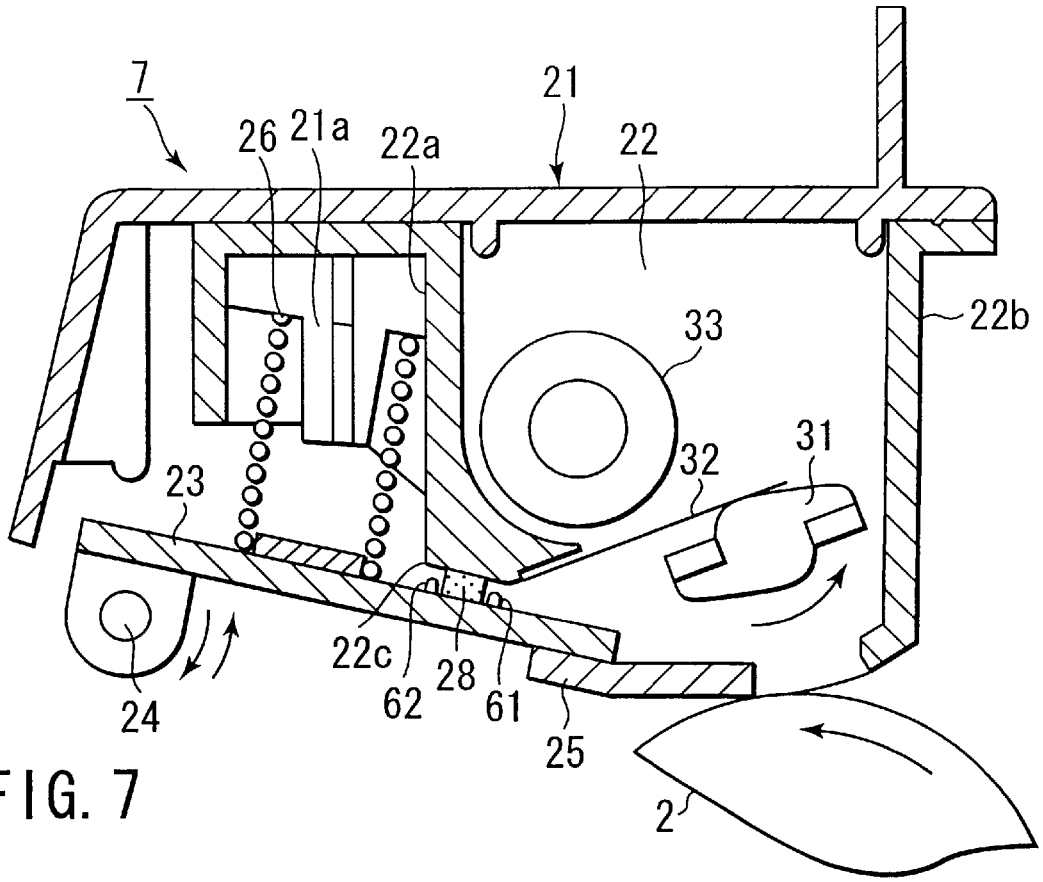
FIG. 7 is an enlarged sectional view showing the closing section between the blade holder and the wall of the toner collecting space in the cleaning apparatus according to the sixth embodiment.

Next, the sixth embodiment of the present invention will be described below with reference to FIG. 7. In the sixth embodiment, the blade holder 23 is formed in a plate, and an attaching face 22*c* inclined to the blade holder 23 is formed on the outer face of the lower portion of the side wall 22*a* forming the toner collecting space 22 so as to be parallel to the photosensitive drum 2. The first face of the elastic seal member 28 is arranged to be parallel to the photosensitive drum 2 and attached to the attaching face 22*c* with use of means such as adhesive. The elastic seal member 28 is arranged between the outer face of the side wall 22*a* forming the toner collecting space 22 and the blade holder 23 facing the side wall 22*a*. In this arrangement, the face (the second face) of the elastic seal member 28 on the side of the blade holder 23 is forcibly brought into contact with the blade holder 23. On the both sides of the elastic seal member 28, there are provided protrusions 61 and 62 for preventing the leak of the toner raked by the blade 25 through the space between the blade holder 23 and the attaching face 22*c* of the toner collecting space 22. The protrusions 61 and 62 are provided on the side where the second face of the elastic seal member 28 contacts without being firmly fixed.

By arranging the protrusions 61 and 62 in this manner, the toner raked by the blade 25 can be prevented from leaking through the space between the blade holder 23 and the attaching face 22*c* of the toner collecting space 22.

Figure 8:
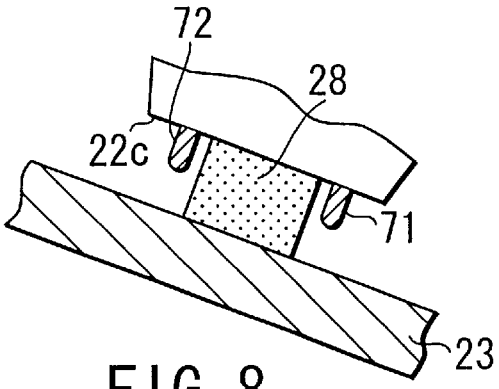
FIG. 8 is an enlarged sectional view showing the closing section between the blade holder and the wall of the toner collecting space in the cleaning apparatus according to the seventh embodiment.

In the case where the elastic seal member 28 is attached to the blade holder 23, protrusions 71 and 72 are attached to the attaching face 22*c*, the side with which the second face of the elastic member 28 is in contact in the seventh embodiment shown in FIG. 8.

Figure 9:
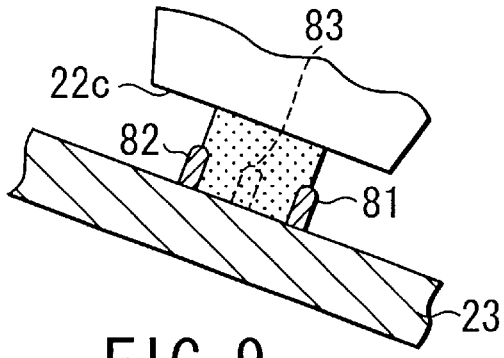
FIG. 9 is an enlarged sectional view showing the closing section between the blade holder and the wall of the toner collecting space in the cleaning apparatus according to the eighth embodiment.

Further, in the case where the elastic seal member 28 is attached to the attaching face 22*c* as in the eighth embodiment shown in FIG. 9, protrusions 81 and 82 may be attached to the blade holder 23 such that a part of the protrusions 81 and 82 wedge into the elastic seal member 28. The other arrangement in which a protrusion 83 is attached to the blade holder 23 such that the protrusion 83 wedges into the elastic seal member 28 may be also acceptable.

Figure 10:
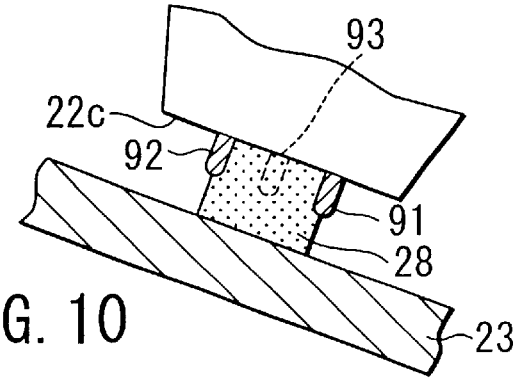
FIG. 10 is an enlarged sectional view showing the closing section between the blade holder and the wall of the toner collecting space in the cleaning apparatus according to the ninth embodiment.
Figure 11:
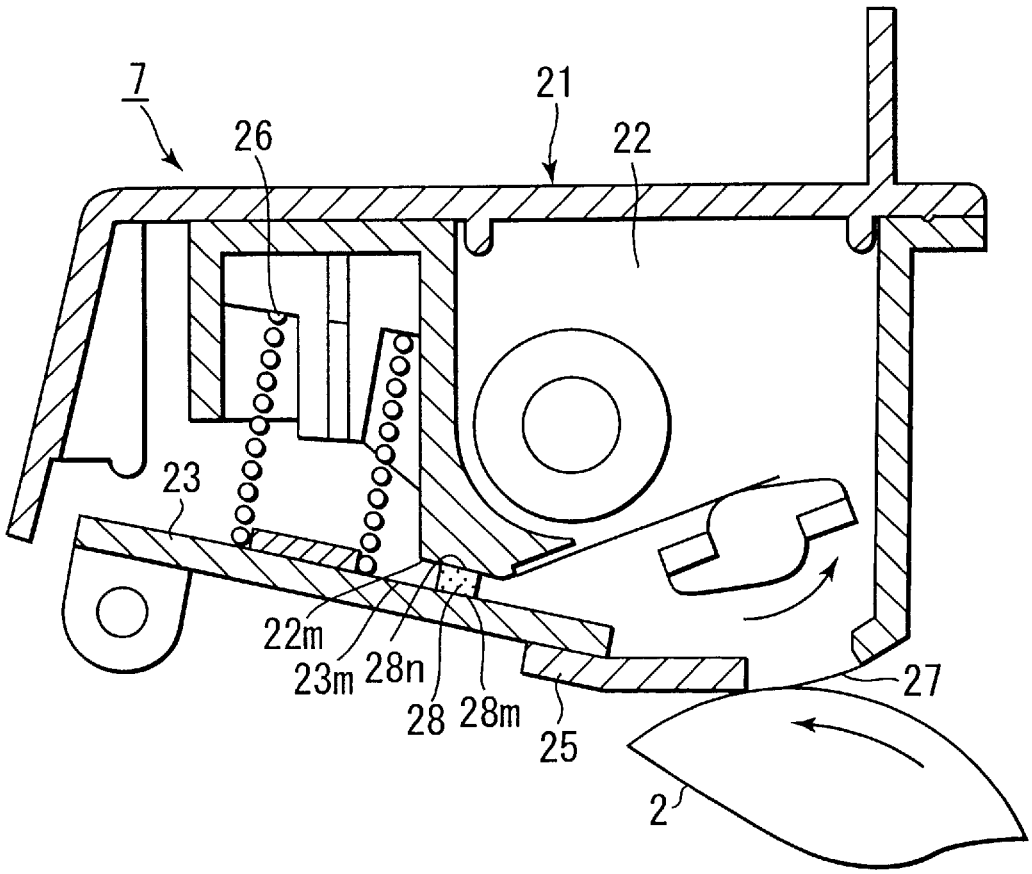
FIG. 11 (PRIOR ART)
FIG. 11 is a sectional view showing the conventional cleaning apparatus.

Still further, in the case where the elastic seal member 28 is attached to the blade holder 23 as in the ninth embodiment shown in FIG. 10, protrusions 91 and 92 may be attached to the attaching face 22*c* such that a part of the protrusions 91 and 92 wedge into the elastic seal member 28. The other arrangement in which a protrusion 93 is attached to the attaching face 22*c* such that the protrusion 93 wedges into the elastic seal member 28 may be also acceptable.

In the above-mentioned embodiments, the blade 25 is forcibly brought into contact with the photosensitive drum 2 by applying a force to the blade holder 23 with use of the urging force of the compressed coil spring 26 in the direction in which the blade holder 23 approaches the photosensitive drum 2, but the compressed coil spring 26 does not necessarily used in the apparatus. Instead of the use of the compressed coil spring 26, the blade holder 23 is formed of a flexible material such as a plate spring and the blade 25 is urgingly contact with the circumference of the photosensitive drum 2 by fixing one end of the blade holder 23 at a fulcrum member attached to the device case 21.

Furthermore, protrusions 29, 41, 42, 83, 93 are described as facing the second face of the elastic seal member 28. However, the protrusions 29, 41, 42, 83, 93 are desirably provided on the face opposite to the second face for obtaining more adhesive effects and toner leakage preventing effects. Protrusions 29, 41, 42, 83, 93 may be provided on the first face of the elastic seal member 28 if they can be fixed. with this structure, toner leakage preventing effects will be improved, because protrusions 29, 41, 42, 83, 93 make the contact pressure of the second face of the elastic seal member 28 much higher.

The present invention is not limited to the above-mentioned embodiment and it will be obvious to those of ordinary skill in the art various modifications can be attained within a scope from where the spirit of the invention as defined can be maintained free from any deviation.

Additional advantages and modifications will readily occur to those skilled in the art. Therefore, the invention in its broader aspects is not limited to the specific details and representative embodiments shown and described herein. Accordingly, various modifications may be made without departing from the sprit or scope of the general inventive concept as defined by the appended clams and their equivalents.

What is claimed is:

1. A cleaning device comprising:

a device case forming a toner collecting space having an opening that faces a surface of a photosensitive drum;

a blade holder swingably supported by the device case in directions in which the blade holder approaches and leaves from the photosensitive drum and extending to the opening of the toner collecting space;

a blade attached to the blade holder in order to rake up toner left on the surface of the photosensitive drum toward inside of the toner collecting space;

an urging member that applies a force to the blade holder in the direction in which the blade holder approaches the photosensitive drum so that the blade urgingly contacts onto the surface of the photosensitive drum;

an elastic seal member attached to one of a wall forming the toner collecting space and the blade holder, between an outer face of the wall forming the toner collecting space and the blade holder facing the wall; and a protrusion attached to one of the blade holder and the wall forming the toner collecting space in order to prevent toner raked by the blade from leaking through a space between the blade holder and the wall of the toner collecting space.

2. A cleaning device according to claim 1, wherein said protrusion is located near the elastic seal member.

3. A cleaning device according to claim 1, wherein said protrusion is at least partly wedged into the elastic seal member.

4. A cleaning device according to claim 1, wherein said protrusion is located at one of the wall forming the toner collecting space and the blade holder where said elastic seal member is unattached.

5. A cleaning device according to claim 1, wherein said urging member comprises an elastic member and said protrusion is partly wedged into a surface of the elastic seal member, at which the elastic seal member faces one of the blade holder and the wall of the toner collecting space.

6. A cleaning device according to claim 5, wherein said protrusion is located at one of the wall forming the toner collecting space and the blade holder where said elastic seal member is unattached.

7. The cleaning device according to claim 6, wherein the protrusion comprises a corner of a bending portion formed on one of the blade holder and the wall of the toner collecting space.

8. The cleaning device according to claim 6, wherein the protrusion comprises a pointed section.

9. The cleaning device according to claim 6, wherein the protrusion comprises a waved section.

10. An image forming apparatus comprising:

a feeding section for feeding a recording paper;

a photosensitive drum;

an exposing device for forming an electrostatic latent image on the photosensitive drum;

a developing device for developing the electrostatic latent image by supplying toner to a circumference of the photosensitive drum to form a toner image on the recording paper fed from the feeding section;

a transfer device for transferring the toner image formed on the circumference of the photosensitive drum to the recording paper by making the recording paper contact with the circumference of the photosensitive drum;

a peeling device for peeling the recording paper from the circumference of the photosensitive drum;

a cleaning device for removing and collecting residual toner left on the circumference of the photosensitive drum; and a fixing device for fixing the toner image on the recording paper to which the toner image is transferred, wherein the cleaning device comprises:

a device case forming a toner collecting space having an opening that faces a surface of the photosensitive drum;

a blade holder swingably supported by the device case in directions in which the blade holder approaches and leaves from the photosensitive drum and extending to the opening of the toner collecting space;

a blade attached to the blade holder in order to rake up toner left on the surface of the photosensitive drum toward inside of the toner collecting space;

an urging member that applies a force to the blade holder in the direction in which the blade holder approaches the photosensitive drum so that the blade urgingly contacts onto the surface of the photosensitive drum;

an elastic seal member attached to one of a wall forming the toner collecting space and the blade holder, between an outer face of the wall forming the toner collecting space and the blade holder facing the wall; and a protrusion attached to one of the blade holder and the wall forming the toner collecting space in order to prevent toner raked by the blade from leaking through a space between the blade holder and the wall of the toner collecting space.

11. A image forming apparatus according to claim 10, wherein said protrusion is located near the elastic seal member.

12. An image forming apparatus according to claim 10, wherein said protrusion is at least partly wedged into and encroaches to the elastic seal member.

13. A image forming apparatus according to claim 12, wherein said protrusion is located at one of the wall forming the toner collecting space and the blade holder said elastic seal member is unattached.

14. An image forming apparatus according to claim 12, wherein said urging member comprises an elastic member and said protrusion is partly wedged into a surface of the elastic seal member, at which the elastic seal member faces one of the blade holder and the wall of the toner collecting space.

15. A image forming apparatus according to claim 14, wherein said protrusion is located at one of the wall forming the toner collecting space and the blade holder where forming said elastic seal member is unattached.

16. The cleaning device according to claim 14, wherein the protrusion comprises a corner of a bending portion formed on one of the blade holder and the wall of the toner collecting space.

17. The cleaning device according to claim 14, wherein the protrusion comprises a pointed section.

18. The cleaning device according to claim 14, wherein the protrusion comprises a waved section.

19. A cleaning device comprising:

a device case forming a toner collecting space having an opening that faces a surface of a photosensitive drum;

a blade holder swingably supported by the device case in directions in which the blade holder approaches and leaves from the photosensitive drum and extending to the opening of the toner collecting space;

a blade attached to the blade holder in order to rake up toner left on the surface of the photosensitive drum toward inside of the toner collecting space;

an urging member that applies a force to the blade holder in the direction in which the blade holder approaches the photosensitive drum so that the blade urgingly contacts onto the surface of the photosensitive drum;

an elastic seal member attached to one of the blade holder and an outer face of a wall forming the toner collecting space that faces the blade holder; and a protrusion provided on the other of the blade holder and the outer face of the wall forming the toner collecting space.

20. The cleaning device according co claim 19, wherein the protrusion is at least partly wedged into the elastic seal member.

21. The cleaning device according to claim 19, wherein the urging member comprises a spring.

22. The cleaning device according to claim 20, wherein the protrusion comprises a corner of a bending portion of one of the blade holder and the wall of the toner collecting space.

23. The cleaning device according to claim 20, wherein the protrusion comprises a pointed section formed on one of the blade holder and the wall of the toner collecting space.

24. The cleaning device according to claim 20, wherein the protrusion comprises a waved section formed on one of the blade holder and the wall of the toner collecting space.

25. The cleaning device according to claim 20, wherein the elastic seal member comprises a sponge.

26. The cleaning device according to claim 20, wherein a width of the protrusion is less than a width of a surface of the elastic seal member that faces the protrusion.

27. A process unit comprising:

a photosensitive drum;

a device case forming a toner, collecting space having an opening that faces a surface of the photosensitive drum;

a blade holder swingably supported by the device case in directions in which the blade holder approaches and leaves from the photosensitive drum and extending to the opening of the toner collecting space;

a blade attached to the blade holder in order to rake up toner left on the surface of the photosensitive drum toward inside of the toner collecting space;

an urging member that applies a force to the blade holder in the direction in which the blade holder approaches the photosensitive drum so that the blade urgingly contacts onto the surface of the photosensitive drum;

an elastic seal member attached to one of the blade holder, and an outer face of a wall forming the toner collecting space, that faces the blade holder; and a protrusion provided on the other of the blade holder and the outer face of the wall forming the toner collecting space.

28. The process unit comprising according to claim 27, wherein the protrusion is at least partly wedged into the elastic seal member.

29. The process unit comprising according to claim 27, wherein the urging member comprises a spring.

30. The process unit according to claim 27, wherein the elastic seal member comprises a sponge.

31. The process unit comprising according to claim 27, wherein a width of the protrusion is less than a width of a surface of the elastic seal member that faces the protrusion.

32. An image forming apparatus comprising:

a photosensitive drum;

a developing device that develops an electrostatic latent image by supplying toner to a circumference of the photosensitive drum to form a toner image; and a cleaning device that removes and collects residual toner left on the circumference of the photosensitive drum;

wherein the cleaning device comprises:

a device case forming a toner collecting space having an opening that faces a surface of the photosensitive drum;

a blade holder swingably supported by the device case in directions in which the blade holder approaches and leaves from the photosensitive drum and extending to the opening of the toner collecting space;

a blade attached to the blade holder in order to rake up toner left on the surface of the photosensitive drum toward inside of the toner collecting space;

an urging member that applies a force to the blade holder in the direction in which the blade holder approaches the photosensitive drum so that the blade urgingly contacts onto the surface of the photosensitive drum;

an elastic seal member attached to one of the blade holder and an outer face of a wall forming the toner collecting space that faces the blade holder; and a protrusion provided on the other of the blade holder and the outer face of the wall forming the toner collecting space.

33. The image forming apparatus according to claim 32, wherein the protrusion is at least partly wedged into the elastic seal member.

34. The image forming apparatus according to claim 32, wherein the urging member comprises a spring.

35. The image forming apparatus according to claim 32, wherein the elastic seal member comprises a sponge.

36. The image forming apparatus according to claim 32, wherein a width of the protrusion is less than a width of a surface of the elastic seal member that faces the protrusion.

37. The image forming apparatus according to claim 32, wherein the cleaning device is arranged on the photosensitive drum.

* * * * *